United States Patent [19]

Neuwirth

[11] Patent Number: 4,675,779

[45] Date of Patent: Jun. 23, 1987

[54] TELEPHONE PROTECTOR MODULE HAVING SELF-CONTAINED SEALING MEANS

[75] Inventor: Helmuth Neuwirth, Garden City, N.Y.

[73] Assignee: Porta Systems Corp., Syosset, N.Y.

[21] Appl. No.: 899,916

[22] Filed: Aug. 25, 1986

[51] Int. Cl.[4] ..... H01T 4/04

[52] U.S. Cl. ..... 361/119; 174/525; 361/394

[58] Field of Search ..... 361/119, 426, 373, 392, 361/393, 394; 174/525; 379/412; 339/94 R

[56] References Cited

U.S. PATENT DOCUMENTS 4,004,199 1/1977 Pearce et al. ..... 174/525 X 4,307,430 12/1981 Montalto et al. ..... 361/119 X

*Primary Examiner*—A. D. Pellinen

*Assistant Examiner*—H. L. Williams

*Attorney, Agent, or Firm*—Charles E. Temko

[57] ABSTRACT

An improved telephone protector module construction for use with individual subscriber circuits in which the inner end wall having contact means thereon is recessed to accommodate a sealing gasket which surrounds the contact and ground pins, and provides a resilient seal against the corresponding surfaces of the engaged protector block to prevent accumulation of dirt, dust and vermin when installation is made in only partially shielded outdoor locations. The seal is formed from closed cell synthetic resinous sponge rubber so as to be non-absorbtive of ambient moisture while effectively closing the gap normally existing between the inner wall surface of the module and the corresponding surface of the block.

3 Claims, 4 Drawing Figures

TELEPHONE PROTECTOR MODULE HAVING SELF-CONTAINED SEALING MEANS

BACKGROUND OF THE INVENTION

This invention relates generally to the field of telephony, and more particularly to an improved sealing means for effectively preventing the accumulation of dust, dirt, vermin, and other formal material in the area of interconnection between an individual subscriber circuit protector module and the corresponding area upon an engaged protector block.

While most protector block installations are made with an enclosed premises, such as a telephone company central office, outdoor installations in which the protector block is only partially sheltered against the elements are becoming increasingly common. Typical examples are adjacent subscriber owned equipment including a maintenance termination unit. In such installations which may be on an external surface of a building wall, the protector block is housed within a metal box or similar enclosure which provides protection against rain and the like, but which is not hermetically sealed so that with passage of time, particles of dirt, insects and other particulate material may enter the box and implement the formation of corrosion upon the terminal pins or sockets in the module and the protector block at the surfaces of interconnection. While much has been accomplished to provide for the formation of vapor-tight connections which resist such corrosion, the precence of foreign material immediately adjacent said connections accelerates the formation of corrosion, because of retained moisture, thus effectively shortening the life of the vapor-tight connections. As this process occurs, the subscriber line becomes increasingly noisy, ultimately to a point where a service problem is created.

SUMMARY OF THE INVENTION

Briefly stated, the invention contemplates the provision of an improved module construction of the class described, in which the inner end wall of the protector module which engages the protector block is provided with a rectangular recess surrounding the contact pins or sockets which establish electrical communication with the protector block. A thick compressible gasket-like seal of closed cell synthetic resinous sponge material having a thickness slightly greater than the depth of the recess is seated therein to provide a compressible surface between the inner end of the module and the abutted surface of the engaged protector block. The seal effectively prevents the accumulation of foreign material while permitting the escape of entrapped moisture through normal vapor pressure.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
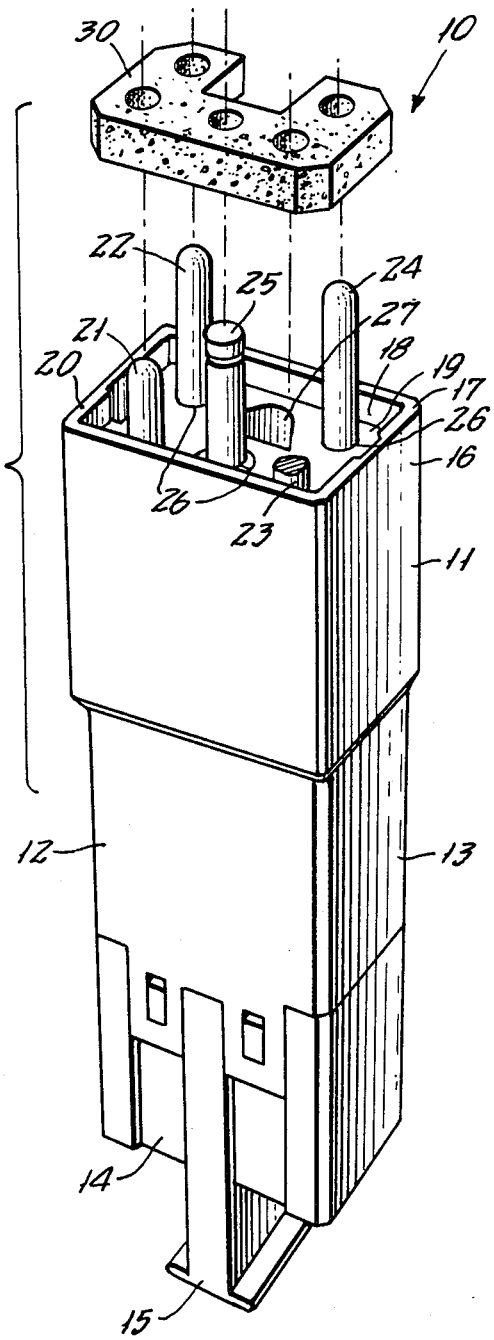
FIG. 1 is an exploded view in perspective of an embodiment of the invention.

In accordance with the invention, the device, generally indicated by reference character 10 is in the form of an individual subscriber circuit protector module. It includes an outer housing element 11 of generally conventional configuration, including a pair of wider side walls, one of which is indicated by reference character 12, and a pair of communicating narrower side walls, one of which is indicated by reference character 13. An outer end thereof is closed by a molded cap 14 which may include a manually engageable handle 15.

The housing element 11 includes an inner end portion 16 bounded by a continuous inner end edge 17 defining a generally rectangular recess 18 with an inner end wall surface 19. Typically, the recess has a depth of approximately 0.10 inches as measured along the continuous peripheral wall surface 20.

The module 10 may include the usual contact pins including tip in 21, tip out 22, ring in 23, and ring out 24, as well as a ground pin 25 which project through corresponding openings 26 in the end wall surface 19. This will normally be the case where the module is intended for use in conjunction with typical Western Electric protector blocks. In the case of modules which are intended for use with protector blocks having contact pins thereon which engage corresponding socket contacts in the module, the end wall surface 19 will have corresponding openings through which such pin projects, as is well known in the art.

Positioned within the recess 18 is a resilient gasket element 30, most conveniently formed by cutting from planar synthetic resinous material. It is bounded by first and second planar surfaces 31 and 32, respectively, longer side surfaces 33, shorter side surfaces 34, and angularly disposed corner surfaces 35, 36, 37, and 38. In the case of the Western Electric type protector module, a rectangular cut out portion 39 overlies an alignment recess 27 in the end wall surface 19.

The element 30 includes first, second, third and fourth through openings 40, 41, 42 and 43, as well as a fifth opening 44 which accommodates the ground pin 25 normally present in any commonly used protector module type.

Figure 2:
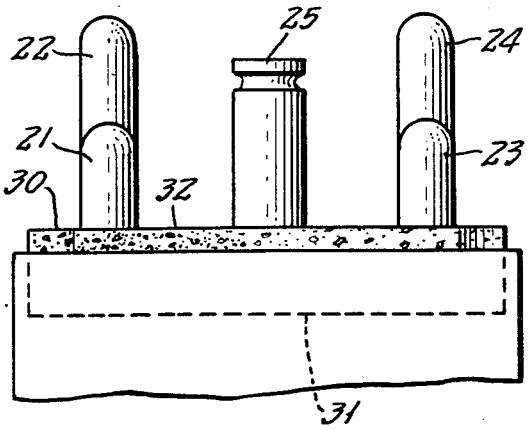
FIG. 2 is an enlarged fragmentary perspective view thereof in assembled condition, corresponding to the upper portion of FIG. 1.
Figure 3:
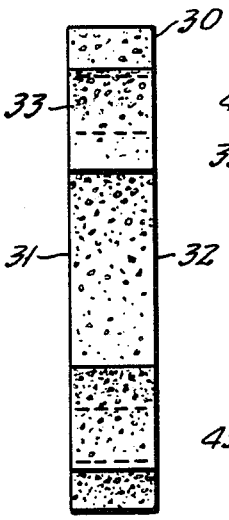
FIG. 3 is an end elevational view of a gasket element comprising the embodiment.
Figure 4:
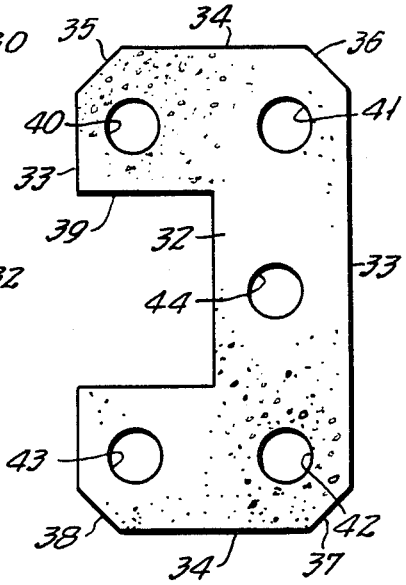
FIG. 4 is a side elevational view of the gasket element, as seen from the right-hand portion of FIG. 3.

Preferably, the element 30 is approximately 0.125 inch thick in unstressed condition, so that when positioned within the recess 18, as shown in FIG. 2 in the drawing, a portion thereof will project outwardly of the recess to compressibly contact the corresponding surface of the connector block upon which the module is engaged.

The module is engaged in normal manner, which will normally position the edge 71 against the protector module and compress the gasket element 30 so as to lie wholly within the recess 18. In this condition, it will effectively surround the conductive pins which are mounted either on the module or the block, and prevent the entry of any foreign material to this critical contact area, while permitting the escape of any moisture which might accumulate. Since the element 30 itself is preferably formed of closed cell material, no moisture will accumulate within the mass thereof, and should the module be exposed to excessive moisture for a period of time, upon a lowering of the humidity level, whatever moisture is present between the device 10 and the connector block will readily evaporate.

I wish it to be understood that I do not consider the invention to be limited to the precise details of structure shown and set forth in this specification, for obvious modifications will occur to those skilled in the art to which the invention pertains.

I claim:

1. An improved telephone protector module for use in outdoor installations upon a corresponding protector block comprising: a housing element having an inner end wall surface, a plurality of communicating side walls extending laterally of said inner end wall surface to define a generally shallow rectangular recess therebetween; said inner end wall surface having through openings therein for establishing electrical communication between said module and a connector block upon which said module may be engaged; a gasket element of planar resilient substantially non-porous material of dimensions corresponding to the configuration of said recess and having through openings corresponding to said openings in said inner end wall surface, said gasket element having a thickness in relatively unstressed condition slightly greater than the axial depth of said recess, and positioned therein so as to project laterally outwardly therefrom; said gasket element, upon engagement of said module with a corresponding area upon a protector block being compressed to form a resilient seal between said protector block and said inner end wall surface of said module, and enclosing said openings in said inner end wall surface and corresponding openings in said protector block.

2. An improved telephone protector module in accordance with claim 1, further characterized in said module having a plurality of contact pins extending axially from said inner end wall surface, said gasket elements surrounding that portion of said pins disposed within said recess.

3. An improved telephone module in accordance with claim 1, further characterized in said gasket element being formed of closed cell synthetic resinous sponge material whereby to prevent the entry and retention of moisture within the mass thereof.

* * * * *